US009406474B2

(12) United States Patent
Sandoval Camacho et al.

(10) Patent No.: US 9,406,474 B2
(45) Date of Patent: Aug. 2, 2016

(54) CIRCUIT BREAKER HEATERS AND TRANSLATIONAL MAGNETIC SYSTEMS

(75) Inventors: Esteban Sandoval Camacho, Monterrey (MX); Stephen Scott Thomas, Atlanta, GA (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/370,995

(22) PCT Filed: Feb. 23, 2012

(86) PCT No.: PCT/US2012/026306

§ 371 (c)(1),
(2), (4) Date: Jul. 8, 2014

(87) PCT Pub. No.: WO2013/126061

PCT Pub. Date: Aug. 29, 2013

(65) Prior Publication Data

US 2015/0035627 A1 Feb. 5, 2015

(51) Int. Cl.

| | |
|---|---|
| ***H01H 9/00*** | (2006.01) |
| ***H01H 89/00*** | (2006.01) |
| ***H01H 71/16*** | (2006.01) |
| ***H01H 50/18*** | (2006.01) |
| ***H01H 50/36*** | (2006.01) |
| ***H01H 61/013*** | (2006.01) |
| ***H01H 61/02*** | (2006.01) |
| *H01H 71/24* | (2006.01) |
| *H01H 71/40* | (2006.01) |

(52) U.S. Cl.

CPC ..... *H01H 89/00* (2013.01); *H01H 50/18* (2013.01); *H01H 50/36* (2013.01); *H01H 61/013* (2013.01); *H01H 61/02* (2013.01); *H01H 71/164* (2013.01); *H01H 71/2463* (2013.01); *H01H 71/402* (2013.01); *H01H 2071/407* (2013.01)

(58) Field of Classification Search

CPC ... H01H 71/74; H01H 71/7463; H01H 89/00; H01H 61/02; H01H 61/013; H01H 50/18; H01H 50/36

USPC ..... 335/1

See application file for complete search history.

(56) References Cited

U.S. PATENT DOCUMENTS 3,081,387 A * 3/1963 Smith ..... H01H 71/345 335/281

(Continued)

FOREIGN PATENT DOCUMENTS

DE 102006005697 A1 8/2007

OTHER PUBLICATIONS

PCT International Search Report mailed Nov. 14, 2012 corresponding to PCT International Application No. PCT/US2012/026306 filed Feb. 23, 2012 (7 pages).

*Primary Examiner* — Shawki S Ismail
*Assistant Examiner* — Lisa Homza

(57) ABSTRACT

A thermal-magnetic trip unit is provided for a circuit breaker. The thermal-magnetic trip unit includes a heater and a translational magnetic system coupled to the heater. The heater includes a first portion, a second portion, and a third disposed between the first portion and the second portion. The first portion has a first surface disposed in a first plane, and the second portion has a second surface disposed in a second plane that is substantially parallel to the first plane. The first surface is separated by a first predetermined distance from the second surface. The third portion has a third surface disposed in a third plane that is substantially perpendicular to the first plane. The third surface has a first predetermined length and is separated by a second predetermined distance from the second surface. Numerous other aspects are provided.

14 Claims, 5 Drawing Sheets

(56) References Cited

U.S. PATENT DOCUMENTS 3,636,410 A * 1/1972 Pardini ..... H01H 71/44 335/35
3,777,293 A * 12/1973 Tuzuki ..... H01H 71/2454 335/176
5,245,302 A * 9/1993 Brune ..... H01H 71/405 335/23
6,972,649 B1 * 12/2005 Murthy ..... H01H 71/2454 335/176
7,391,289 B2 * 6/2008 McCoy ..... H01H 71/16 335/16
8,274,355 B2 * 9/2012 Jun ..... H01H 71/164 200/238
2009/0295532 A1 * 12/2009 Puhalla ..... H01H 71/0207 337/102

* cited by examiner

CIRCUIT BREAKER HEATERS AND TRANSLATIONAL MAGNETIC SYSTEMS

BACKGROUND

This invention relates generally to circuit breakers, and more particularly to circuit breaker heaters and translational magnetic systems.

Circuit breakers typically include one or more electrical contacts, and provide protection against persistent over-current conditions and short circuit conditions. In many circuit breakers, a thermal-magnetic trip unit includes a heater and magnetic system. Existing thermal-magnetic trip units typically include a first planar portion, and a second U-shaped portion disposed around an electromagnetic coil. A bi-metal element may be coupled to the first portion of the heater using a shunt to allow heat transfer from the heater to the bi-metal element, and to locate the bi-metal element in a desired position.

However, the shunt requires numerous additional components and thus increases the cost and complexity of the circuit breaker.

SUMMARY

In a first aspect, a thermal-magnetic trip unit is provided for a circuit breaker. The thermal-magnetic trip unit includes a heater and a translational magnetic system coupled to the heater. The heater includes a first portion, a second portion, and a third disposed between the first portion and the second portion. The first portion has a first surface disposed in a first plane, and the second portion has a second surface disposed in a second plane that is substantially parallel to the first plane. The first surface is separated by a first predetermined distance from the second surface. The third portion has a third surface disposed in a third plane that is substantially perpendicular to the first plane. The third surface has a first predetermined length and is separated by a second predetermined distance from the second surface.

In a second aspect, a circuit breaker is provided that includes a heater and a translational magnetic system coupled to the heater. The heater includes a first portion, a second portion, and a third disposed between the first portion and the second portion. The first portion has a first surface disposed in a first plane, and the second portion has a second surface disposed in a second plane that is substantially parallel to the first plane. The first surface is separated by a first predetermined distance from the second surface. The third portion has a third surface disposed in a third plane that is substantially perpendicular to the first plane. The third surface has a first predetermined length and is separated by a second predetermined distance from the second surface.

In a third aspect, a thermal-magnetic trip unit is provided for a circuit breaker. The thermal-magnetic trip unit includes a heater and a translational magnetic system coupled to the heater. The heater includes a first portion, a second portion, and a third disposed between the first portion and the second portion. The first portion has a first surface disposed in a first plane, and the second portion has a second surface disposed in a second plane that is substantially parallel to the first plane. The third portion includes a third surface disposed in a third plane that is substantially perpendicular to the first plane. The fourth portion is coupled to the second portion and the third portion at a top surface of the second portion. Numerous other aspects are provided.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Existing thermal-magnetic trip units often include a current-carrying heater that has a first portion coupled to a bi-metal element, and a second portion coupled in series with a magnetic system. To open the electrical contacts within specified time limits in response to an over-current condition, the contact area between the bi-metal element and the heater must be sufficiently large. In some existing thermal-magnetic trip units, a bi-metal element is coupled to a planar heater via a shunt. The shunt increases the contact area between the bi-metal element and the heater, but requires numerous additional components and thus increases the cost and complexity of the circuit breaker.

Some existing thermal-magnetic trip units avoid the need for a shunt by using a ramp-shaped heater in which the bi-metal element is coupled to a vertically-oriented portion of the heater. However, such systems typically use a conventional magnetic system in which the second portion of the heater wraps around an electromagnet coil. Such conventional magnetic systems, however, are usually harder to calibrate at high amperage ratings. Also conventional magnetic systems are bulky and require longer heaters to wrap around an electromagnet coil. In view of the foregoing difficulties and desired assembly attributes, improved thermal-magnetic trip units are provided that include a ramp-shaped heater and a translational magnetic system.

Figure 1A:
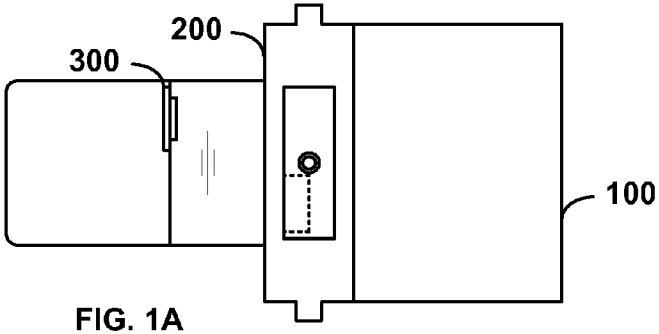
FIGS. 1A-1C are top, front and right-side views of an example thermal-magnetic trip unit in accordance with this invention.
Figure 1B:
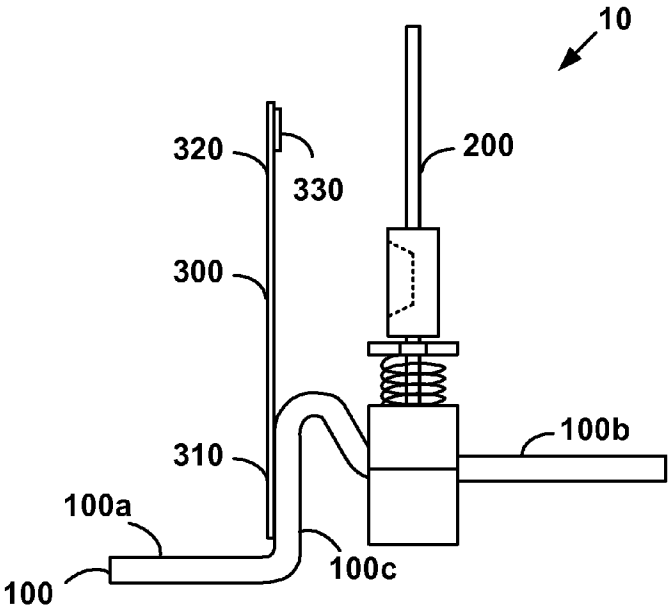
Figure 1C:
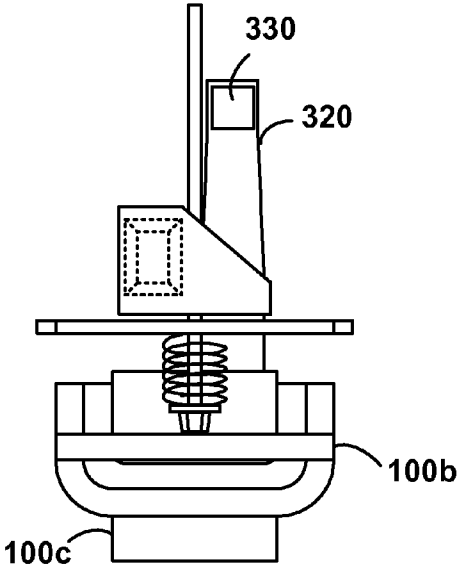

Referring to FIGS. 1A-1C, an example thermal-magnetic trip unit 10 in accordance with this invention is described. Thermal-magnetic trip unit 10 includes a heater 100 coupled to a translational magnetic system 200 and a bi-metal element 300. Heater 100 includes a first portion 100*a*, a second portion 100*b* and a third portion 100*c* disposed between first portion 100*a* and second portion 100*b*. First portion 100*a* may be connected to one or more electrical conductors (not shown), and second portion 100*b* may be connected to one or more load conductors (not shown). Bi-metal element 300 has a first end 310 coupled to third portion 100*c* of heater 100, and has a second end 320 having a contact surface 330. Translational magnetic system 200 is coupled to heater 100 between second portion 100*b* and third portion 100*c*.

Figure 2A:
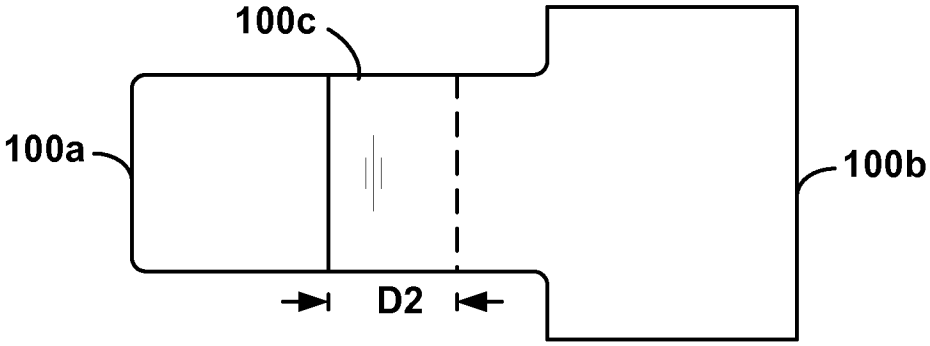
FIGS. 2A-2C are top, front and right-side views of an example ramp-shaped heater for use in thermal-magnetic trip units in accordance with this invention.
Figure 2B:
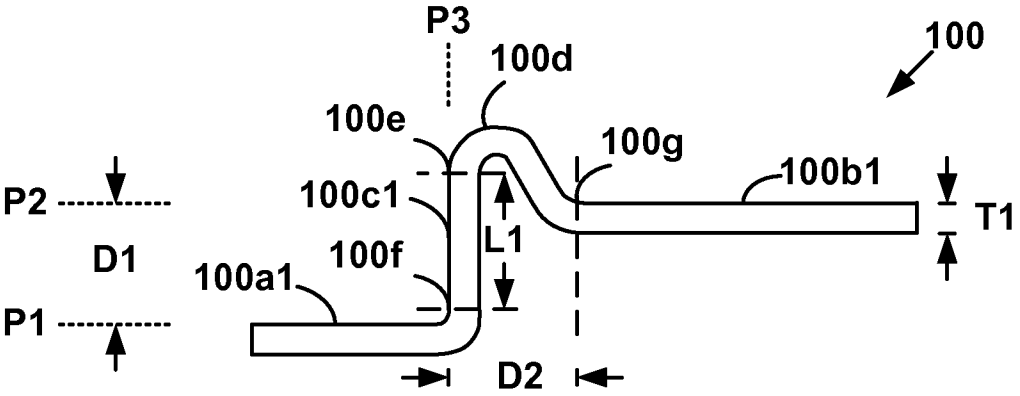
Figure 2C:
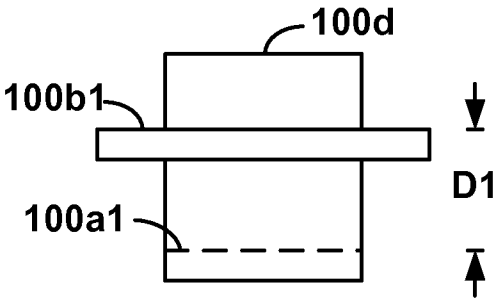

Referring now to FIGS. 2A-2C, example heater 100 is described in more detail. As shown in FIG. 2B, first portion 100*a* has a first surface 100*a*1 disposed in a first plane P1, and second portion 100*b* has a second surface 100*b*1 disposed in a second plane P2 that is substantially parallel to first plane P1. First surface 100*a*1 is separated by a first predetermined distance D1 from second surface 100*b*1.

Third portion 100*c* is disposed between first portion 100*a* and second portion 100*b*, and has a third surface 100*c*1 disposed in a third plane P3 that is substantially perpendicular to first plane P1. In this regard, heater 100 has a ramp-shape. Third surface 100*c*1 has a first predetermined length L1 and extends between upper end 100*e* and lower end 100*f* of third portion 100*c*. Third surface 100*c*1 is separated by a second predetermined distance D2 from a left end 100*g* of second surface 100*b*1 (and second portion 100*b*).

Heater 100 includes a curved portion 100*d* coupled between second portion 100*b* and third portion 100*c*. In particular, curved portion 100*d* extends between left end 100*g* of second portion 100*b* (at a plane parallel to second plane P2) and upper end 100*e* of third portion 100*c* (at a plane parallel to third plane P3).

First predetermined distance D1 and second predetermined distance D2 may be constrained as a result of physical space limitations within the circuit breaker, and/or locations of other components that are coupled to first portion 100*a* and second portion 100*b*. First predetermined distance D1 may be between about 12 mm to about 15 mm, although other dimensions may be used. Second predetermined distance D2 may be between about 14 mm to about 17 mm, although other dimensions may be used.

First predetermined length L1 may be constrained by the minimum required contact area between third portion 100*c* and bi-metal element 300, and the dimensions of bi-metal element 300. For example, if the minimum required contact area is A1, and bi-metal element has a width of W1, first predetermined length must be at least A1/W1. First predetermined length L1 may be between about 15 mm to about 25 mm, although other dimensions may be used.

As shown in FIG. 2B, heater 100 may have a uniform thickness T1 substantially along its entire length. Thickness T1 may be between about 2 mm to about 5 mm, although other dimensions may be used. Persons of ordinary skill in the art will understand that heater 100 alternatively may have a thickness that varies along its length. Heater 100 may be manufactured from copper, copper alloys, or other similar material. Heater 100 may be fabricated using a machine press or other similar method.

Figure 3A:
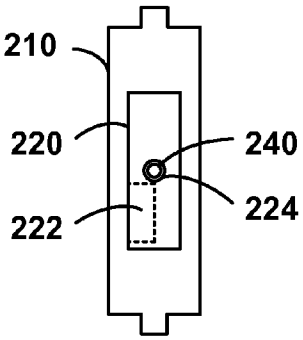
FIGS. 3A-3C are top, front and right-side views of an example translational magnetic system for use in thermal-magnetic trip units in accordance with this invention.
Figure 3B:
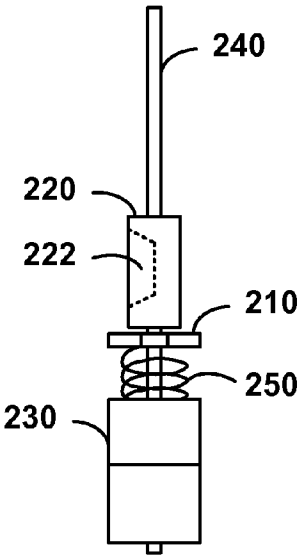
Figure 3C:
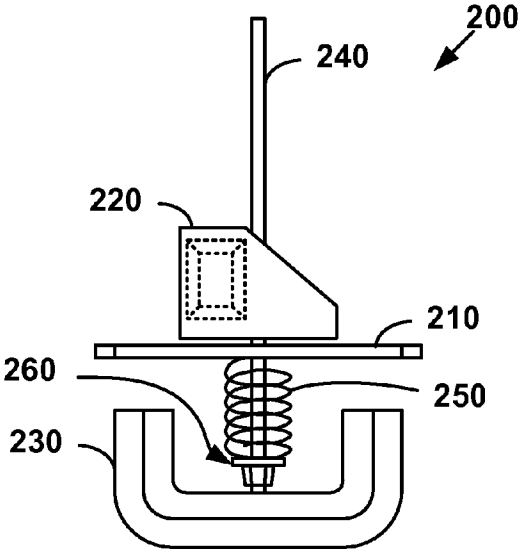

Referring now to FIGS. 3A-3B, example translational magnetic system 200 is described in more detail. Translational magnetic system 200 includes armature 210, an armature locator 220, a yoke 230, an armature guide pin 240, a spring 250, and a calibration nut 260. Armature 210 is coupled to armature locator 220, which includes a recess 222 and a cylindrical bore 224. Armature guide pin 240 extends through cylindrical bore 224 and a comparable cylindrical bore (not shown) in armature 210. In this regard, armature 210 and armature locator 220 may slide on armature guide pin 240. Spring 250 is disposed on armature guide pin 240 between armature 210 and calibration nut 260. Calibration nut 260 can be used to adjust the length and force of spring 250.

Current conduction in heater 100 generates a magnetic field that attracts armature 210 to yoke 230. However, spring 250 biases armature 210 away from yoke 230. For relatively low currents within the rated operating range of the circuit breaker, the magnetic field strength generated by yoke 230 is insufficient to overcome the force provided by spring 250. In a short circuit condition, however, yoke 230 generates a magnetic field strength that overcomes the force of spring 250, causing armature 210 (and armature locator 220) to be pulled down towards yoke 230.

Figure 4C:
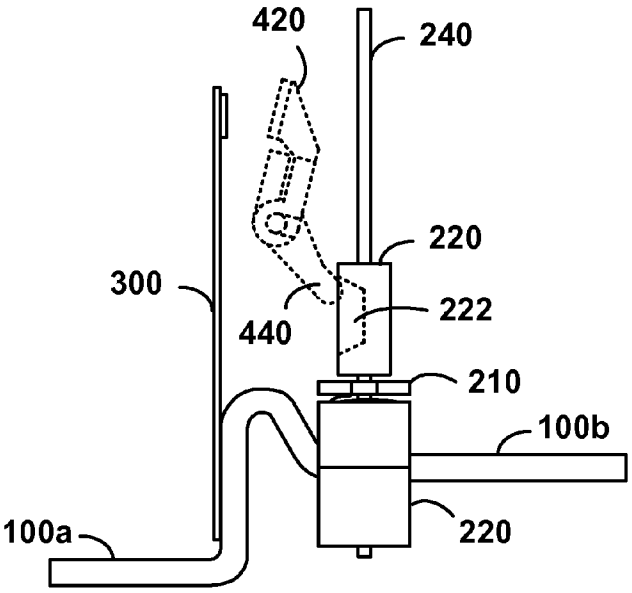
FIG. 4C is a view of the example thermal-magnetic trip unit of FIG. 4A in a short-circuit operating condition.
Figure 4B:
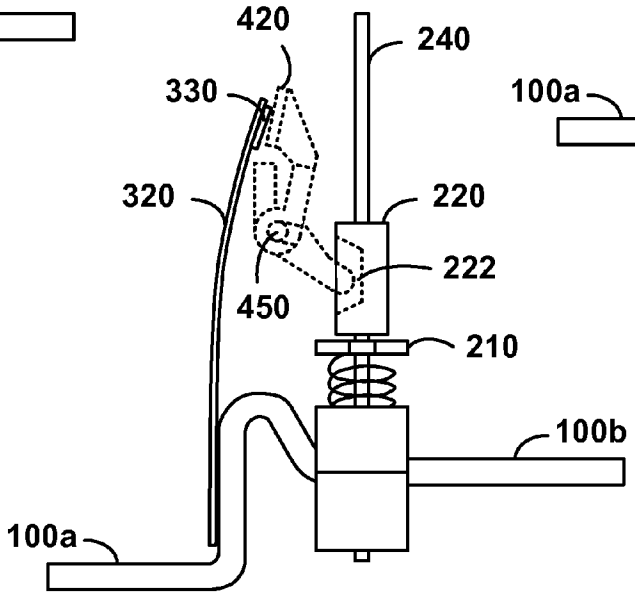
FIG. 4B is a view of the example thermal-magnetic trip unit of FIG. 4A in an over-current operating condition.
Figure 4A:
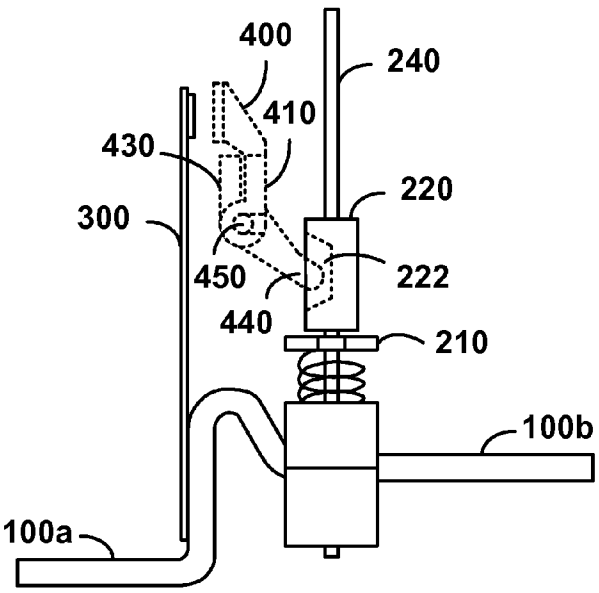
FIG. 4A is a more detailed view of the example thermal-magnetic trip unit of FIG. 1B.

Referring now to FIGS. 4A-4C, the operation of thermal-magnetic trip unit 10 in three different operating modes is described. FIG. 4A depicts example thermal-magnetic trip unit 10 in an initial, non-trip condition. FIG. 4A is similar to FIG. 1B, but also includes a thermal-magnetic trip bar 400 that includes a thermal trip bar 410 that has a bi-metal interface 420, and a magnetic trip bar 430 that has an armature interface 440, with the thermal trip bar 410 and the magnetic trip bar 430 mounted on a common pivot point 450. Bi-metal interface 420 is disposed adjacent contact surface 330 of bi-metal element 300, and armature interface 440 is disposed in recess 222 of armature locator 220.

Referring now to FIG. 4B, the operation of thermal-magnetic trip unit 10 in a first operating condition (e.g., an overcurrent or thermal trip condition) is described. When an overcurrent condition occurs, the temperature of bi-metal element 300 increases, and second end 320 of bi-metal strip 300 begins to deflect from its initial position. If the temperature of bi-metal element 300 increases sufficiently, due to the current draw exceeding a predefined level, contact surface 330 engages bi-metal interface 420 of thermal trip bar 410. As a result, thermal trip bar 410 rotates clockwise about pivot point 450 from its initial position to a second, tripped position, which activates a trip mechanism (not shown) and opens electrical contacts (not shown) of the circuit breaker.

Referring now to FIG. 4C, the operation of thermal-magnetic trip unit 10 in a second operating condition (e.g., a short-circuit or magnetic trip condition) is described. As described above, when a short circuit condition occurs, yoke 230 generates a magnetic field that is sufficiently strong to overcome the force of spring 250, and cause armature 210 to move downward from its initial position on armature pin 240. As a result, armature locator 220 engages armature interface 440, which causes magnetic trip bar 430 to rotate clockwise about pivot point 450. In addition, magnetic trip bar 430 engages thermal trip bar 110, which causes thermal trip bar 110 to rotate clockwise about pivot point 450 from its initial position to the second, tripped position, which activates the trip mechanism and opens electrical contacts of the circuit breaker.

Figure 5:
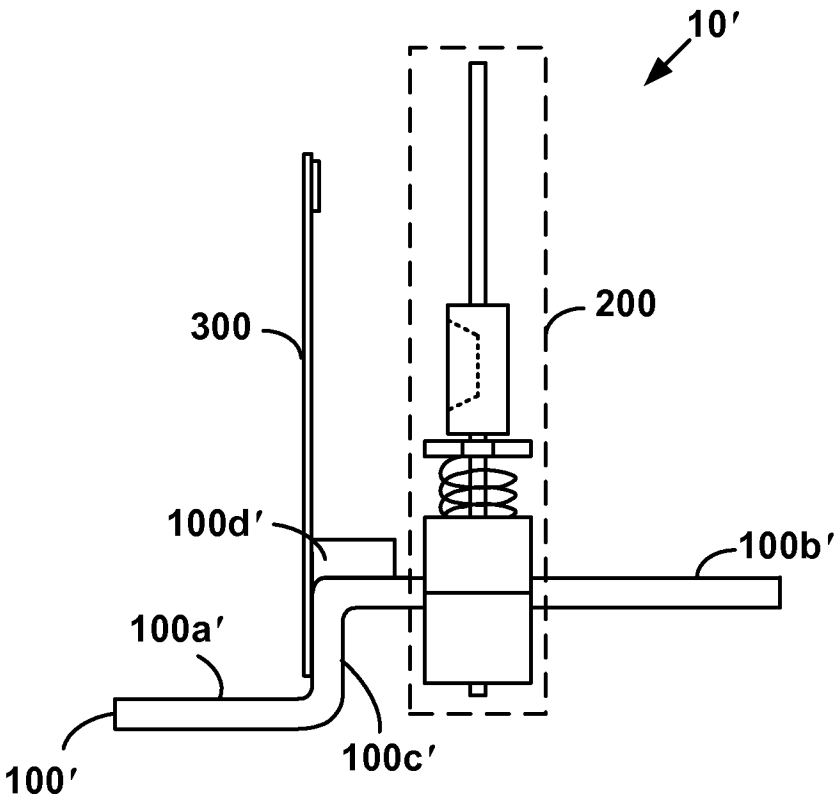
FIG. 5 is a view of an alternative example thermal-magnetic trip unit in accordance with this invention

Referring now to FIG. 5, an alternative example thermal-magnetic trip unit 10' in accordance with this invention is described. Thermal-magnetic trip unit 10' includes a heater 100' coupled to a translational magnetic system 200 and a bi-metal element 300. Heater 100' includes a first portion 100*a*', a second portion 100*b*' and a third portion 100*c*' disposed between first portion 100*a*' and second portion 100*b*'. In addition, heater 100' includes a fourth portion 100*d*' coupled between second portion 100*b*' and third portion 100*c*' at a top surface of second portion 100*b*'. Bi-metal element 300 is coupled to third portion 100*c*' and fourth portion 100*d*'. Translational magnetic system 200 is coupled to heater 100' between second portion 100*b*' and third portion 100*c*'.

Compared with heater 100, alternative heater 100' has two substantially right-angle bends instead of a ramp shape, and requires fewer bends, but third portion 100*c*' has a smaller surface area for contacting bi-metal element 300. Fourth portion 100*d*' provides additional surface area for contacting bi-metal element 300. Fourth portion 100*d*' may be fabricated from the same or different material as heater 100', and may be bonded to second portion 100*b*' using adhesives, fasteners, brazing, welding, or other similar method.

The foregoing merely illustrates the principles of this invention, and various modifications can be made by persons of ordinary skill in the art without departing from the scope and spirit of this invention.

The invention claimed is:

1. A thermal-magnetic trip unit for a circuit breaker, the thermal-magnetic trip unit comprising:

a heater comprising;

a first portion having a first surface disposed in a first plane;

a second portion having a second surface disposed in a second plane that is substantially parallel to the first plane, wherein the first surface is separated by a first predetermined distance from the second surface;

a third portion disposed between the first portion and the second portion, the third portion comprising a third surface disposed in a third plane that is substantially perpendicular to the first plane, wherein the third surface has a first predetermined length and is separated by a second predetermined distance from the second surface wherein the first predetermined distance is measured parallel to the third plane and the first plane and second planes are different planes, and the second predetermined distance is measured parallel to the first plane; and a translational magnetic system coupled to the heater.

2. The thermal-magnetic trip unit of claim 1, wherein the heater further comprises a curved portion coupled between the second portion and the third portion.

3. The thermal-magnetic trip unit of claim 2, wherein the curved portion extends between an end of the second portion and an end of the third portion.

4. The thermal-magnetic trip unit of claim 1, wherein the heater comprises a uniform thickness substantially along its entire length.

5. The thermal-magnetic trip unit of claim 1, wherein the translational magnetic system is coupled between the first portion and the second portion.

6. The thermal-magnetic trip unit of claim 1, wherein the translational magnetic system comprises an armature and armature locator disposed above a yoke.

7. A thermal-magnetic trip unit for a circuit breaker, the thermal-magnetic trip unit comprising:

a heater comprising;

a first portion having a first surface disposed in a first plane;

a second portion having a second surface disposed in a second plane that is substantially parallel to the first plane, wherein the first surface is separated by a first predetermined distance from the second surface;

a third portion disposed between the first portion and the second portion, the third portion comprising a third surface disposed in a third plane that is substantially perpendicular to the first plane, wherein the third surface has a first predetermined length and is separated by a second predetermined distance from the second surface; and a translational magnetic system coupled to the heater wherein the translational magnetic system comprises an armature and armature locator disposed above a yoke, and wherein the translational magnetic system further comprises an armature guide pin, wherein the armature and the armature locator are adapted to slide on the armature guide pin.

8. A circuit breaker comprising:

a heater comprising;

a first portion having a first surface disposed in a first plane;

a second portion having a second surface disposed in a second plane that is substantially parallel to the first plane, wherein the first surface is separated by a first predetermined distance from the second surface; and a third portion disposed between the first portion and the second portion, the third portion comprising a third surface disposed in a third plane that is substantially perpendicular to the first plane, wherein the third surface has a first predetermined length and is separated by a second predetermined distance from the second surface wherein the first predetermined distance is measured parallel to the third plane and the first plane and second planes are different planes, and the second predetermined distance is measured parallel to the first plane; and a translational magnetic system coupled to the heater.

9. The circuit breaker of claim 8, wherein the heater further comprises a curved portion coupled between the second portion and the third portion.

10. The circuit breaker of claim 9, wherein the curved portion extends between an end of the second portion and an end of the third portion.

11. The circuit breaker of claim 8, wherein the heater comprises a uniform thickness substantially along its entire length.

12. The circuit breaker of claim 8, wherein the translational magnetic system is coupled between the first portion and the second portion.

13. The circuit breaker of claim 8, wherein the translational magnetic system comprises an armature and armature locator disposed above a yoke.

14. The circuit breaker of claim 13, wherein the translational magnetic system further comprises an armature guide pin, wherein the armature and the armature locator are adapted to slide on the armature guide pin.

* * * * *